US006776876B1

(12) United States Patent
Vuorinen et al.

(10) Patent No.: US 6,776,876 B1
(45) Date of Patent: Aug. 17, 2004

(54) METHOD OF TREATING CELLULOSIC PULP TO REMOVE HEXENURONIC ACID

(75) Inventors: Tapani J. Vuorinen, Espoo (FI); U. Johanna Buchert, Espoo (FI); Anita B.-L. Teleman, Espoo (FI); T. Maija Tenkanen, Espoo (FI)

(73) Assignee: Andritz Oy, Helsinki (FI)

( * ) Notice: Subject to any disclaimer, the term of this patent is extended or adjusted under 35 U.S.C. 154(b) by 1373 days.

(21) Appl. No.: 08/925,321

(22) Filed: Sep. 8, 1997

Related U.S. Application Data

(63) Continuation of application No. 08/542,646, filed on Oct. 13, 1995, now abandoned.

(30) Foreign Application Priority Data

Oct. 13, 1994 (FI) ..... 944808

(51) Int. Cl.[7] ..... D21C 3/20

(52) U.S. Cl. ..... 162/65; 162/76; 162/78; 162/88

(58) Field of Search ..... 162/76, 78, 65, 162/80, 89

(56) References Cited

U.S. PATENT DOCUMENTS 5,143,580 A 9/1992 Basta et al.

FOREIGN PATENT DOCUMENTS

| | | |
|---|---|---|
| CA | 1 2 0 6 7 0 4 | 7/1986 |
| CA | 2139246 | 10/1992 |
| CA | 2067296 | 3/1997 |
| EP | 0 511 695 A1 | 11/1992 |
| EP | 0 622 491 A2 | 11/1994 |
| GB | 10627341 | 3/1964 |
| WO | WO 9311296 | 6/1993 |

OTHER PUBLICATIONS

Marechal, The Journal of Wood Chemistry and Technology, 13:2 (1993) pp. 261–281.

Lachenhal, D. et al., Tappi Proceedings, Instrumental Pulp Bleaching Conference, 1982, pp. 145–151.

Buchert et al., 3rd European Workshop on Lignocellulosics and Pulp, Stockholm, 28.–31.8.1994.

Devenyns, J. et al., Tappi Pulping Conference Proceedings, 1994, 381–388.

Bouchard, J. et al., International Pulp Bleaching Conference 1994, 33–39.

Teleman, M. et al., The 8th International Symposium on Wood and Pulping Chemistry, Jun. 6–9, 1995, Helsinki, Finland.

*Primary Examiner*—Steve Alvo
(74) *Attorney, Agent, or Firm*—Nixon & Vanderhye P.C.

(57) ABSTRACT

Chemical cellulose pulp produced by alkaline delignification and having a kappa number of under 24 (e.g. 14 or below) having hexenuronic acid is treated to remove at least 50% of the hexenuronic acid (e.g. 90–97%) such as by treating the pulp at a temperature over 85° C. (e.g. about 90–180° C., preferably about 90–110° C.) at a pH between about 2–5 (e.g. about 2.5–4), which also results in a reduction of kappa number by at least two units (e.g. about 2–9 units, preferably about 3–6 units). The treatment time t, in minutes, is at least 0.5 exp(10517/(T+273)−24), where T is the treatment temperature in degrees C. The chemical cellulose pulp is bleached in at least one bleaching stage; where the bleaching stage is a chlorine dioxide, ozone, or peracid, treatment takes place before bleaching. Under some other circumstances treatment can take place simultaneous with bleaching or after bleaching.

27 Claims, 2 Drawing Sheets

METHOD OF TREATING CELLULOSIC PULP TO REMOVE HEXENURONIC ACID

This is a file wrapper continution of application Ser. No. 08/542,646, filed Oct. 13, 1995 now abandoned.

BACKGROUND AND SUMMARY OF THE INVENTION

The present invention relates to a method of producing and treating chemical cellulose pulps so as to minimize the use of bleaching chemicals and/or to optimize bleaching sequences.

Pulp mills have recently attempted to abandon the use of elementary chlorine, and sometimes chlorine dioxide as well. The reasons for this appear to be both environmental and economical (market acceptance). Disadvantages caused by elementary chlorine include both considerable malodorous gaseous emissions and liquid effluents from chemical pulp mills into water systems. Chlorine dioxide does not cause odor problems as significant as those of chlorine, but discharges to waterways are a concern. When comparing these chlorine chemicals with each other by means of the AOX number designating the loading on water systems, elementary chlorine is many times more detrimental than chlorine dioxide.

During the past few years, a large number of chlorine-free bleaching methods have been developed, often using oxygen, ozone, and/or peroxide. However, in many countries sequences using chlorine dioxide are also popular because the price of chlorine dioxide is very competitive compared with that of other chemicals (today approximately half of the price of competing peroxide). Also the strength and brightness values achieved by chlorine dioxide bleaching are at least approximately of the same scale as those for hydrogen peroxide bleaching at the same consumption of chemical (kg/adt).

When bleaching of cellulose pulps is effected using oxygen, peroxide or ozone, removal of heavy metals is almost essential. Detrimental metals include manganese, copper and iron, which catalyze reactions harmful to the quality of pulp. They degrade bleaching chemicals, which decreases the efficiency of bleaching and increases the consumption of chemicals. In cellulose pulps, heavy metals are primarily bound to carboxyl acid groups.

It has been suggested that removal of metals be effected in such a way that prior to the critical bleaching stage, pulp is pre-treated with an acid, e.g. sulphuric acid. Published Canadian patent application 1206704 discloses that the acid treatment is carried out at a temperature of at least 50° C., preferably at 60 to 80° C., at pH 1 to 5. It is stated in the publication that even acid treatment at a lower temperature results in significant removal of detrimental metal ions, but acid treatment at the temperatures according to the publication modifies lignin so that dissolution thereof is significantly improved in alkaline peroxide treatment following the add treatment (Lachenal, D. et al., Tappi Proceedings, International Pulp Bleaching Conference, 1982, p. 145–161). Thus, the acid stage causes the kappa number to drop in the peroxide stage, whereas no decrease in the kappa number has been found in the acid stage. It is also stated that in theory, the acid treatment could be effected even at a temperature of 100° C., but this could result in pulp of poorer quality.

In published EP patent application 511695 it is suggested that after acid treatment, metal ions advantageous for peroxide bleaching, such as magnesium ions, should be added, since some of these desirable magnesium ions are removed in the acid treatment. According to this publication, the acid treatment is effected at a temperature of 10 to 95° C., most preferably at 40 to 80° C., and at pH 1 to 6, most preferably 2 to 4.

The acid treatment is followed by a stage in which suitable alkaline earth metal is added. Further, it is mentioned that during acid treatment, pulp can be treated with a suitable bleaching and/or delignification chemical, such as chlorine dioxide.

Removal of detrimental metals may be made more efficient by using chelating agents for binding metals in connection with the acid treatment. One such method is disclosed in the SE patent 501651, which brings forward an acid treatment similar to that in the above-mentioned EP publication 511695, with the difference being that acid treatment is effected in the presence of a chelating agent. However, chelating agents used for binding metals contribute to increased bleaching costs.

The primary aim of the above-described acid treatments of pulp is to achieve such a composition of metals which is preferable for chlorine-free bleaching chemicals. In these stages, the kappa number may be decreased by 1 to 2 units due to a washing and extraction phenomenon. As mentioned earlier, the metal composition affects the consumption of bleaching chemicals, the reason for the use of known acid stages being therefore removal of metals from the pulp.

One of the most important disadvantages of prior art bleaching is an undesirably large consumption of bleaching chemicals, especially chlorine-free ones, which significantly raises the production costs of bleached pulp. Also with chlorine dioxide bleaching there must be attempts to reduce the consumption of $ClO_2$ both for financial and environmental reasons. Further, a degree—in some cases a great degree—of brightness reversion is a typical feature of pulps bleached with oxygen and peroxide.

The invention seeks to eliminate or minimize the disadvantages of the prior art and to provide a totally new procedure for bleaching cellulose pulps, in particular cellulose pulps delignified under alkaline conditions, by means of either totally chlorine-free bleaching chemicals, or by using chlorine dioxide. The cellulose pulp produced according to the invention is easily bleached, e.g. by means of oxygen and/or peroxide.

It is known that cellulose pulps contain 4-O-methyl-α-D-glucuronic acid groups (glucuronic acid groups). According to the invention it has been discovered that sulphate pulps also contain, in addition to glucuronic acid groups, a significant amount of 4-deoxy-β-L-threo-hex-4-enopyranosyl uronic acid groups (i.e. hexenuronic acid groups) bound to xylan. The amount of hexenuronic acid in some pulps is even substantially greater than the amount of known glucuronic acid groups. The term "hexenuronic acid" as used in the present specification and claims encompasses all 4-deoxy-β-L-threo-hex-4-enopyranosyl uronic acid groups.

It has been discovered that in bleaching of pulp, hexenuronic acid consumes bleaching chemicals reacting electrophilically, such as chlorine, chlorine dioxide, ozone and peracids (Buchert et al., 3rd European Workshop on Lignocellulosics and Pulp, Stockholm, 28.-31.8.1994). However, the hexenuronic acid does not affect the consumption of oxygen and hydrogen peroxide used as bleaching chemicals in alkaline conditions, because they do not react with hexenuronic acid. Thus, no degradation of hexenuronic acid occurs in oxygen and/or peroxide bleaching. Instead, special problems of bleaching pulp with oxygen and/or peroxide are relatively low brightness, and/or a tendency of such pulps to undergo brightness reversion.

The invention is based on the concept that by selectively removing hexenuronic acid from cellulose pulps in connection with bleaching it is possible to reduce the consumption of bleaching chemicals. Surprisingly, it has been discovered that at the same time, the brightness reversion tendency of pulp decreases. Also, bleaching becomes more selective, since the heavy metals can be removed more efficiently.

The selective removal of hexenuronic acid according to the invention is effected in part by making the water suspensions of cellulose pulps slightly acidic—typically, the pH is set between about 2 and about 5—and by treating the water suspensions at an elevated (above ambient) temperature. To achieve a preferable result the temperature is at least about 85° C., most preferably at least about 90° C. Practical utilization of temperatures as high as this has previously been avoided in acid treatment, because it has been assumed that the quality of pulp would suffer. The primary purpose of acid treatment has been removal of detrimental metals. In above-described acid treatments, the purpose of which is removal of metals, the temperature does not play a significant role. What is significant is that the pH of the pulp is so low that metals separate from fibers. In laboratories the treatment is generally carried out at room temperature (20–25° C.). In mills removal of metals is typically effected at a temperature of between 60 to 85°C., which is the temperature prevailing naturally in the acid treatment stage due to water circulations. If a mill wished to practice acid treatment at a higher temperature for some reason, the acid treatment stage would have to be separately heated with steam or the like. This has naturally been avoided since it has been assumed that the strength qualities of the pulp would deteriorate. Therefore, according to what has been known so far, there has been no reason to use hot [over 85° C.] acid stages. The higher temperatures mentioned in the prior art (e.g. CA 1206704) only mean that removal of metals is also possible at higher temperatures.

Duration of the treatment does not play a significant role for removal of metals, except insofar as it is sufficiently long to allow metals separation, typically over 10 minutes. Extra time is not harmful for removal of metals but it naturally causes extra costs to the mill, since long treatment times require use of larger tanks. Large tanks have also been avoided because it has been feared that the acid stage would harm the strength qualities of the pulp. Thus, long treatment times in connection with add stages as mentioned in the prior art only mean that a long treatment time does not have a harmful effect on removal of metals.

In particular, it has to be noted that there have been definite reasons for avoidance of long and hot (e.g. 2 to 3 hours and 85° C.) acid treatments in mill conditions. These above-described reasons have been so significant that prior to the invention it has not been discovered that the kappa number of pulp can be decreased by 2 to 9, preferably 3 to 6, units by means of this kind of treatment. Not even in laboratory experiments has this been discovered, since the whole idea has been regarded as being contrary to all existing knowledge. What is especially surprising is that such acid treatment can be carried out without damaging the strength qualities of pulp, if the kappa number of the pulp to be treated has been made to drop sufficiently, i.e. under about 24, preferably under about 14, by cooking or possibly further delignification, despite the fact that pulp treatment with both acid (stage A) and chelating agents (stage Q) has been examined intensively during the last five years in connection with peroxide bleaching. Therefore, it is very surprising that a relatively long and hot acid stage is desirable when both a high temperature and a long time, even when used separately, have previously been regarded as detrimental factors in connection with acid treatment of pulp.

It should also be noted that pH in known acid treatments has to be rather low, i.e. 1.5–2, for decreasing e.g. the manganese content of the pulp considerably. In the pH range below 2, the carboxylic acid type groups become entirely protonated, resulting in low metal levels. Between pH 2 and 6, metal ions compete with hydrogen ions for the carboxyl acid sites, resulting in increasing metal levels as pH increases (Devenyns, J. et al., Tappi Pulping Conference Proceedings, 1994, 381–388; Bouchard, J. et al., International Pulp Bleaching Conference 1994, 33–39). On the other hand, in the method of the present invention the carboxyl acid type groups (hexenuronic aids) are removed, which means that the number of the carboxyl acid sites is decreased and the pulp can become occupied by metals to a lesser extent.

Practicing the invention it is possible to easily produce bleached cellulose pulp by means of a sulphate method or an equivalent alkaline method that forms hexenuronic acid in the pulp. It is characteristic of the pulp manufactured according to the invention that it contains at most only a small amount of hexenuronic acid, and can be easily bleached without chlorine (ECF) or chlorine-containing chemicals (TCF), or even with mere oxygen gas and/or peroxide. The consumption of bleaching chemicals can also be substantially reduced. Further, it is typical of the pulp produced in this way that, expressed as a pc-number, the brightness reversion thereof is smaller than 2.

The treatment of the pulp in a water suspension practiced according to the invention in acidic circumstances at a temperature of over 85° C. is hereafter also called "acidic pre-treatment". According to the invention, cellulose pulp is treated in the presence of water at a temperature of at least 85° C. at a pH in the range from about 2 to about 5 (typically at a pH in the range from 2.0–5.0) in order to remove hexenuronic acid from the cellulose pulp. Preferably, the pH value of the water suspension of the cellulose pulp is maintained between 2.5 and 4.0. The lowest pH values (2.5 to 3.5) are preferable for softwood and the highest (3 to 4) for hardwood.

Various acids—inorganic acids, e.g. mineral acids such as sulphuric, nitric and hydrochloric acid, and organic acids such as formic and/or acetic acid—may be used to set the pH value for the pulp slurry. If so desired, the acids may be buffered, e.g. with the salts of the acids, such as formiates, in order to keep the pH value as even as possible during the treatment. There may be great variations in the temperature, ranging from just above 85° C. upwardly. Preferably, the temperature is kept at about 90 to 110° C. If the treatment is practiced under atmospheric conditions, 100° C. is a natural maximum limit, however even higher temperatures are possible if pressure vessels are used. Thus, the treatment may be effected in a bleaching tank under a pressure of about 200 to 500 kPa, at a temperature of about 110 to 130° C. To avoid excessive degradation of fiber, the maximum limit of the temperature is usually set to about 180° C. (unless chemicals or treatments can be provided which give temperature protection).

The duration of the treatment varies according to the pH value, the temperature, and the specific pulp treated. Naturally, it also depends on how complete the removal of hexenuronic acids is desired to be. In general, the treatment time is at least t minutes, where t=0.5 exp(10517/(T+273)−24) (t=0.5 exp(10517/(T+273)−24)). T is the temperature of the acid treatment in degrees C. The degradation of hexenuronic acid groups is in accordance with first-order reaction kinetics. It is known that the relation between reaction rate constant k and temperature T (degrees Kelvin) is $k=A\,e^{-E/RT}$ (Arrhenius Relationship), where A is the constant depending on the reaction in question, E the activation energy and R the gas constant. On the other hand it is known that for the first-order reaction the reaction time in minutes is t=(1/k)ln ($c_o$/c), where c is the concentration of the hexenuronic acids and $c_o$ is the original concentration. By using the Arrhenius equation and t=(1/k)ln ($c_o$/c) and test results (e.g. from Example 8 below) the equation of t=0.5 exp(10517/(T+273)−24) was obtained. In general t is between 5 minutes and 10 hours. In the examples described below, the treatment is practiced under atmospheric conditions. The typical treatment time at a temperature of 90° C. is about 1.5 to 6 hours, at 95° C. about 50 minutes to 5 hours, at 100° C. about 0.5 to 4 hours. Under pressure, e.g. at a temperature of 120 to 130° C., the treatment may be effected typically within about 5 to 50 minutes.

The intention is to remove as large a part of the hexenuronic acid as possible, preferably at least about 50%, especially preferably at least about 80%, and most suitably at least about 90% (e.g. about 90–97%). The concept "pulp contains at most a small amount of hexenuronic acid" means that the amount of hexenuronic acid is at most 50%, especially preferably at most 25%, and most suitably at most 10% of the amount which is present after cooking in corresponding pulp which has not been treated. To prevent excessive degradation of carbohydrate substance, no attempts are usually made to remove the hexenuronic acid completely, i.e., there is no attempt to remove more than about 97–99% of the hexenuronic acid.

The treatment may be continuous (e.g. in a flow-through reactor), or batch. Pulp is treated in the presence of water, in other words the pulp received from the pulp cooking (and/or other delignification) process is slurried with water so that the consistency of the slurry in the pre-treatment according to the invention is about 0.1 to 60% (solids by weight), preferably about 1–20%. The pre-treatment is preferably effected by mixing. In continuous mixing, stationary mixers may be used.

The invention may be practiced with pulps which are produced by means of a sulphate process or other alkaline methods, and contain hexenuronic acid. The term "sulphate process" means a cooking method in which the primary cooking chemicals are sodium sulfide and sodium hydroxide (kraft cooking). Other alkaline cooking processes include, for example, extended cooks based on extending conventional sulphate cooking until the kappa number of the pulp has dropped below the value of approximately 20. These methods typically include oxygen treatment. Extended cooking methods include, for example, extended batch cooking (+AQ), EMCC® available from Kamyr, Inc. of Glens Falls, N.Y., batch cooking, Super-Batch/$O_2$, MCC®/$O_2$ available from Kamyr, Inc. of Glens Falls, N.Y., and continuous cooking/$O_2$. According to experiments, hexenuronic acid forms about 0.1 to 10 mol-% (a significant amount) of the hydrolysis products of the xylanase treatment of softwood pulp received from these cooking methods. After pre-treatment according to the invention the concentration of hexenuronic acid will drop to about 0.01 to 1 mol-%.

In the specification, the term "in connection with bleaching" means that the acidic pre-treatment is effected either prior to bleaching, during bleaching or, at the latest, after bleaching. When substances reacting electrophilically, e.g. chlorine, chlorine dioxide, ozone or peracids, are used as bleaching chemicals, it is especially preferable to effect pre-treatment prior to bleaching because in this way it is possible to reduce the consumption of bleaching chemicals. It if the treatment is practiced on unbleached pulp it changes characteristics. e.g. bleachability, of the cellulose pulp. On the other hand, when using oxygen gas and/or peroxide in bleaching (or bleaching treatment), it is also possible to effect pre-treatment according to the invention after bleaching. In the latter case, the treatment is preferably carried out immediately after bleaching prior to possible drying of the pulp (i.e. to air-dried pulp). The pre-treatment may be effected between the bleaching stages of a bleaching sequence.

The following are examples of suitable bleaching sequences:

A-O-Z-P
AQ-O-Z-P
A-O-ZQ-P
A-O-Pn
AQ-O-Pn
O-A-Z-P
O-AQ-Z-P
O-A-ZQ-P
O-A-Pn
O-AQ-Pn
O-A-D-E-D
O-AD-E-D
A-O-D-E-D
O-A-X-Pn

In the above sequences the following symbols are used:

A=acidic pre-treatment at an elevated temperature according to the invention;

O=oxygen treatment;

P=peroxide treatment;

$P_n$=several subsequent peroxide treatment stages;

E=alkali stage;

Z=ozone treatment (ZQ meaning that complexing agent is added in ozone treatment);

Q=complexing agent treatment (AQ meaning that complexing agent is added in add treatment);

D=chlorine dioxide treatment (AD meaning that there is no washing between the stages);

X=enzyme treatment; and

"-"=between stage washing.

Between bleaching stages using an oxygen chemical, there may be alkali stages. In order to make bleaching more efficient, known enzymes, such as cellulases, hemicellulases and lignases, may be employed.

The pre-treatment according to the invention is effected in a bleaching sequence either prior to an oxygen or peroxide stage, or subsequent to that, but prior to a chlorine dioxide stage, ozone stage or peracid stage (e.g. a formic acid or peracetic acid stage), in order to reduce the consumption of ozone and/or peracids. Since it is possible to improve bleachability of pulps by the pre-treatment according to the invention, the invention enables the consumption of bleaching chemicals to be significantly reduced, and/or the use of chlorine dioxide, ozone or peracids in bleaching to be eliminated.

Many chemical methods of producing chemical pulp have as the last stage an oxygen delignification stage. The pre-treatment of the invention may be effected either prior to this oxygen stage, or subsequent to it, preferably subsequent to the oxygen stage. In bleaching of hardwood pulp, the consumption of chlorine dioxide has decreased by 30–40% at a brightness level ISO 88%, the bleaching sequence being O-A-D-E-D. In bleaching softwood pulp, the corresponding reduction of consumption has been 10–20%. In both cases the yield has remained almost unchanged compared with bleaching without a stage A. Additionally, experiments have shown that stage D following stage A may be carried out without washing between the stages, in other words with the sequence O-AD-E-D.

In chlorine-free bleaching sequences comprising a bleaching stage with an electrophilic bleaching chemical, e.g. ozone or peracid, it is preferable that the acid treatment is carried out prior to the first stage Z, and preferably in such a way that the pulp is washed before moving on to stage Z, in order to guarantee efficient removal of hexenuronic acid from the pulp. The ozone consumption caused by hexenuronic acid (HexA) and thereby also the decrease in chemical consumption by practicing the method according to the invention can be calculated theoretically by taking into account that the hexenuronic acid consumes an equivalent amount of ozone (1 eq $O_3$/HexA). Typically, the saving in the consumption is 1 to 3 kg $O_3$ per ton pulp. In the acid treatment, furan derivatives forming out of hexenuronic acid consume twice the amount of ozone, and therefore it is preferable to wash the pulp as efficiently as possible after the acid treatment, prior to the bleaching stage. [The above discussion is applicable to all other chlorine-free electrophilic bleaching chemicals, such as peracetic acid, persulphuric acid, and peroxomolybdates.]

Reducing the consumption of the bleaching chemical by acid treatment according to the invention is based on the fact that in removal of hexenuronic acid, the amount of reactive acid groups in bleaching is decreased, and thus there will also be less material to be bleached.

According to one preferable embodiment, the primary bleaching chemical used is a peroxide-containing substance (usually hydrogen peroxide). Thus, it is possible to produce pulp, the brightness reversion tendency of which, expressed as a post number pc [number], is smaller than 2. The brightness reversion tendency cannot be prevented by any other efficient way than by removing hexenuronic acid. Since in the acid treatment according to the invention detrimental heavy metal concentrations are also reduced, it is preferable to effect the acid treatment prior to the first P-stage. Peroxide treatment is most suitably accompanied by oxygen gas pre-treatment.

The pH of the pulp slurry treated with oxygen is first set to the value of about 3–4 and the temperature of the pulp is raised to about 90–130° C., and it is kept at that temperature at least 5 minutes, subsequent to which it is treated with hydrogen peroxide under alkaline conditions in order to produce bleached pulp. Instead of hydrogen peroxide, a peroxide-containing substance may be used (for example Caro's acid or a corresponding substance), which degrades in suitable conditions (e.g. alkaline conditions) to form hydrogen peroxide or peroxo-ions.

In order to remove heavy metals bound to the cellulose pulp, the pre-treatment according to the invention may be effected in the presence of chelates which bind heavy metals. EDTA and DTPA are examples of suitable chelating agents. In general, chelating agents are dosed into the pulp in the proportion of about 0.2% of the pulp by weight. However, an advantage of the acidic pre-treatment according to the invention is that metals can be removed rather efficiently even without chelating agent treatment, as disclosed in Example 10.

Acidic pre-treatment may also be practiced to unbleached or bleached pulp to modify characteristics relating to the qualities of paper. Thus, by removing acid groups water retention capacity of the pulp can be decreased, whereby it is possible to produce stiffer pulp applicable for use in packing boards, for example.

According to one aspect of the present invention a method of treating chemical cellulose pulp produced by alkaline delignification and having a kappa number of under 24, having hexenuronic acid therein, comprises the steps of: (a) Treating chemical cellulose pulp produced by alkaline delignification having a kappa number under 24 by removing at least 50% of the hexenuronic acid from the pulp. And, (b) bleaching the chemical cellulose pulp produced by alkaline delignification having a kappa number under 24 in at least one bleaching stage. Step (a) is typically practiced by treating the pulp at a temperature over 85° C. and at a pH between about 2–5 for sufficient time to remove at least 50% of the hexenuronic acid and to reduce the kappa number by at least 2 units. Typically step (a) is practiced for at least a time t, where $t=0.5\exp(10517/(T+273)-24)$, in minutes, and where T is the treatment temperature in degrees C.

While step (a) may be practiced prior to, substantially simultaneously with, or after step (b), where step (b) is practiced by bleaching the pulp electrophilically (using chlorine, chlorine dioxide, ozone, peracid, etc.) step (a) is practiced before step (b). During the practice of step (a) the pulp has a consistency of between 0.1–50%, preferably about 1–20%. Step (a) is most desirably practiced at a temperature of between about 90–110° C. and a pH of between about 2.5–4 and for between five minutes to ten hours, most desirably between 10–240 minutes. The pulp treated in step (a) may be hardwood pulp having a kappa number of about 14 or less, or softwood pulp with such a kappa number. Where step (b) is practiced by bleaching the pulp in an ozone stage it is typically followed by at least one additional bleaching stage. Step (a) is practiced to reduce the kappa number about 3–6 units under most circumstances, and desirably to remove at least 80% of the hexenuronic acid (e.g. about 90–97%), and to produce pulp with a pc-number small than 2 (even if step (b) is peroxide bleaching).

According to another aspect of the present invention, a method of producing chemical cellulose pulp is provided comprising the following steps: (a) Effecting alkaline delignification of comminuted cellulosic fibrous material to produce chemical cellulose pulp having a kappa number of under 24, and having hexenuronic acid therein (e.g. at a concentration of about 0.1–10 mol-% of the hydrolysis products with x y lanase thereof). (b) Treating the chemical cellulose pulp from step (a) at a temperature of between 85–180° C. and at a pH between about 2–5 for at least a time t, where $t=0.5\exp(10517/(T+273)-24)$, in minutes, and where T is the treatment temperature in degrees C., to remove at least 50% of the hexenuronic acid from the pulp (e.g. to reduce the concentration thereof to about 0.01–1 mol-% of the hydrolysis products with x y lanase). And, (c) Bleaching the chemical cellulose pulp from step (a) in at least one bleaching stage prior to, simultaneously with, or after step (b). Step (b) is typically practiced at atmospheric pressure for a time between 10–360 minutes, or when at superatmospheric pressure over 100° C. for a time between 5–100 minutes; and to remove about 90–97% of the hexenuronic acid.

The invention also contemplates cellulose chemical pulp produced by the steps of: (a) Effecting alkaline delignification of comminuted cellulosic fibrous material to produce chemical cellulose pulp having a kappa number of under 24, and having hexenuronic acid therein. (b) Treating the chemical cellulose pulp from step (a) at a solids consistency between 0.1–50% at a temperature of between 86–180° C. and at a pH between 2.0–6.0 for at least a time t, where t=0.5 exp(10517/(T+273)−24), in minutes, and where T is the treatment temperature in degrees C., to remove at least 50% of the hexenuronic acid from the pulp. And (c) bleaching the chemical cellulose pulp from step (a) in at least one bleaching stage prior to, simultaneously with, or after step (b), so that the pulp has a brightness of at least about 80 ISO (preferably at least 90 ISO). Even where step (e) is peroxide bleaching, the pulp produced still has a pc number less than 2.

It is a primary object of the present invention to significantly enhance the bleachability of chemical cellulose pulp produced by alkaline delignification. This and other objects of the invention will become clear from an inspection of the detailed description of the invention and from the appended claims.

DETAILED DESCRIPTION

Figure 1:
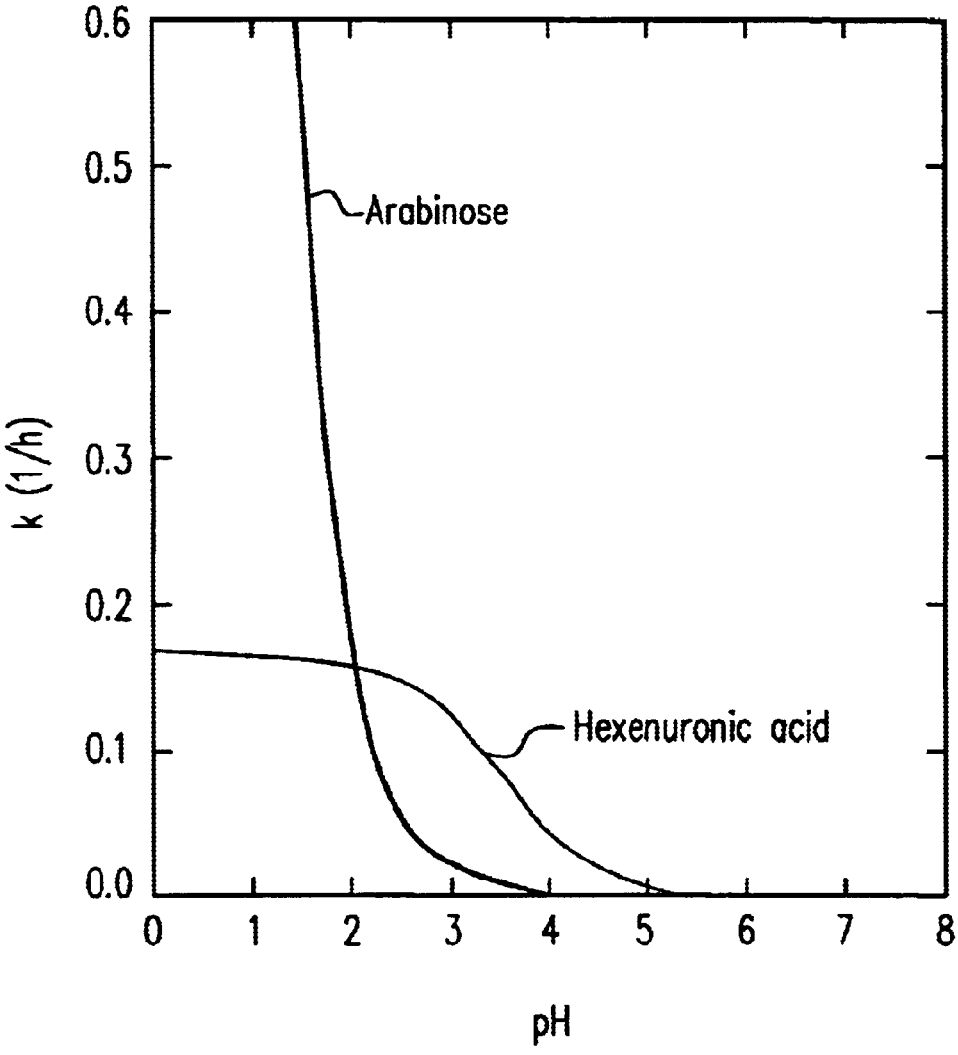
FIG. 1 is a graphical representation illustrating the effect of acidity on hydrolysis velocities of arabinose amd hexenuronic acid of pine sulfate pulp at a temperature of about 80° C.

FIG. 1 graphically illustrates the effect of acidity on the hydrolysis velocities of arabinose acid groups and hexenuronic acid of pine sulphate pulp at a temperature of about 80° C. Theoretical curves have been fitted to experimental points in accordance with the equations illustrated in Example 2 respectively.

Figure 2:
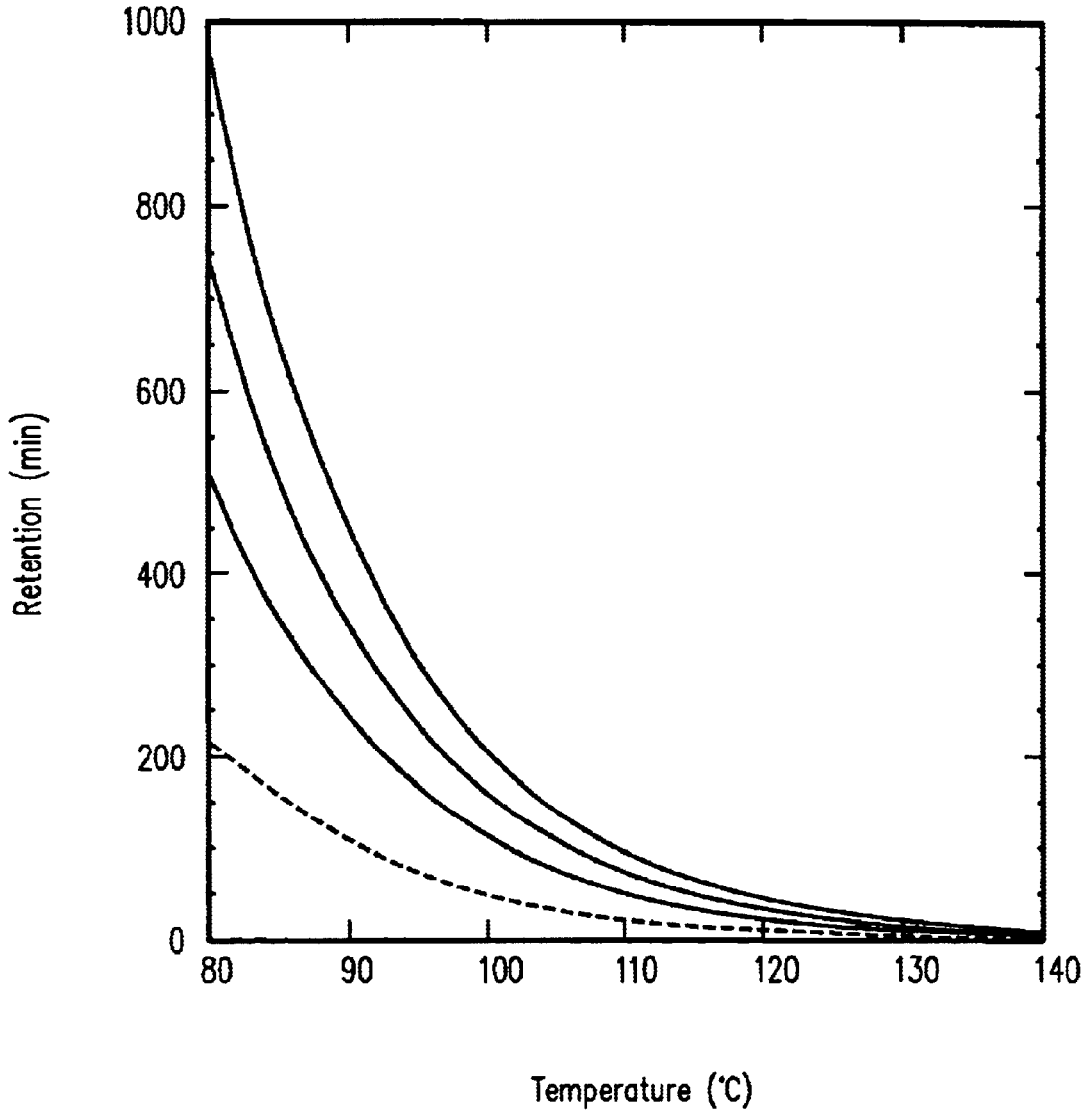
FIG. 2 is a graphical representation of reaction time plotted against temperature for different levels of hexenuronic acid removal.

FIG. 2 illustrates the dependency of the time necessary for removal of hexenuronic acid on the temperature at a scale of 80 to 140° C., birch sulphate pulp having been treated with acid at pH 3.5, according to the invention. At this pH the reaction velocity is nearly maximal. At higher pH values the retention time should be longer at a certain temperature. The three upper curves illustrate the optimal operating range, wherein 95%, 90% and 80%, respectively, of the hexenuronic acid has been removed. The broken line illustrates the lowest limit of the retention time, where 60% of the hexenuronic acid has been removed.

In the examples below the kappa numbers of the pulps have been defined according to standard SCAN-C 1:77, the viscosity according to standard SCAN-CM 15:88, and the brightness according to standard SCAN-C 11:75. The brightness reversion tendency is measured by means of a dry heating method (24 h, 105° C.). The PC number was counted from the results.

EXAMPLE 1

4-O-methylglucuronoxylan isolated from hardwood was treated in 1 M sodium hydroxide liquor at a temperature of 160° C. for 2 hours. The liquor was cooled and the xylan precipitated from the liquor by adjusting the liquor neutral. The precipitated xylan was washed and dried, subsequent to which it was treated with endoxylanase. The hydrolysate was fractionated by using anion exchange chromatography and gel filtration. In this way, the oligosaccharide fraction was isolated, which fraction was by means of NMR spectroscopy discovered to contain 4-deoxy-p-L-threo-hex4-enuronoxylotriose (80%) and -tetraose (20%).

Part of the oligosaccharide liquor was dissolved into 10 mM acetate buffer (pH 3.7) in deuterium oxide. The liquor was inserted into an NMR tube and changes therein were followed by means of 1H NMR spectroscopy at a temperature of 80° C. for 17 hours.

The degradation of hexenuronic acid groups was in accordance with the first order. The conversion was 55% 17 hours after the reaction time. Hydrolysis of xylosidic linkages was not to be discovered. When hexenuronic acid degraded, an almost equivalent amount of compounds was generated, which compounds were identified as furan-2-carboxylic acid ($\delta_{H3}$=7.08 ppm), $J_{H3'H4}$=3.5 hz, $J_{H4,H5}$=1.7 Hz, $J_{H5}$=0.8 Hz), and formic acid ($\delta_H$=8.37 ppm). In addition, a small amount of component identified as 2-furaldehyde-5-carboxylic acid ($\delta_{H3}$=7.13 ppm, $\delta_{H4}$=7.52 ppm, $\delta_{CHO}$=9.60 ppm, $J_{H3,H4}$=3.5 Hz) was generated.

According to the example, the hexenurosidic linkages may be selectively hydrolyzed under mild conditions without significant hydrolysis of xylosidic linkages. Correspondingly, it can be concluded that glucosidic and mannosidic linkages of cellulose and glucomannan, being stronger than xylosidic linkages of xylan, are stable in these conditions.

EXAMPLE 2

Pine sulphate pulp (kappa number 25.9) was incubated in buffered liquors (pH 1.5–7.8) at different temperatures (25, 50 and 80° C.) for 2 hours. Subsequent to the treatments, the pulp samples were washed with water. The washed pulps were treated with xylanase, and the hydrolysates were analyzed by means of $1_H$ NMR spectroscopy.

Changes in the carbohydrate composition of the pulp were found only at the highest temperature used (80° C.). Deviating from hydrolysis of ordinary glycosides, hydrolysis of hexenuronic acid groups was not directly proportional to the hydronium ion concentration (Equation 1), but the pH dependancy of the reaction velocity clearly showed that the reaction occured through a free hexenuronic acid group without catalysis caused by a bydronium ion (Equation 2, FIG. 1).

$$k=k_O[H_3O^+] \quad (1)$$

$$k=k_O\{1/(1+K_a/[H_3O_+])\} \quad (2)$$

According to the example, hexenuronic acid groups of the cellulose pulp may be selectively removed under slightly acidic conditions (pH>2) at a raised temperature. Partial hydrolysis of arabinose groups occurs, but the loss in yield caused by this is diminutive due to the low concentration of arabinose in cellulose pulps (softwood pulps 1%, hardwood pulps 0%).

EXAMPLE 3

The oligosaccharide liquor (15.5 mg, 0.025 mmol) was added into boiling 0,01 M formiate buffer (pH 3.3, 27 ml). The liquor was refluxed for 3 hours. Samples (0.5 ml) were taken at suitable intervals and diluted with water (5 ml). The absorption of light was measured at a wavelength scale of 200–500 nm. Forming of furan-2-carboxylic acid (λmax=250 nm) was in accordance with the first order (k=0,44 $h^{-1}$).

The molar absorptivity calculated per amount of the hexenuronic acid groups was 8,700. This absorptivity value may be used to define the hexenuronic acid concentration of cellulose pulps.

EXAMPLE 4

The oligosaccharide mixture (2.0 mg, 3.22 μmol) was dissolved into water (4.8 ml). 0.6 ml 2 M sulphuric acid and 0.6 ml 0.02 M potassium permanganate (12.0 μmol) was added into the liquor. In ten minutes, 0.12 ml 1 M potassium iodide and 100 ml water was added into the liquor. The iodine concentration of the liquor was defined spectrophotometrically (350 nm, ϵ=16,660). The consumption of permanganate was calculated on the basis of Equation 3.

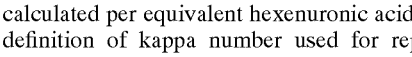

$$2MnO_4^- + 10I^- + 16H^+ \rightarrow 2Mn^{2+} + 5I_2 + 8H_2O \quad (3)$$

The consumption of permanganate was 7.98 μmol, i.e. 2.5 calculated per equivalent hexenuronic acid group. Since the definition of kappa number used for representing lignin concentration of cellulose pulps is done under exactly the same reaction conditions, hexenuronic acid groups may cause a considerable error in respect to the real lignin concentration.

EXAMPLE 5

Birch sulphate pulp (3 g, kappa number 16.5) was treated in 0.06 M formiate buffer (pH 3.2, 250 ml) at a temperature of 100° C. for 4 hours. Degradation of hexenuronic acid groups was followed by means of absorption of light (250 nm, ϵ=8,700) caused by 2-furan-carboxylic acid. The total amount of bexenuronic acid groups was calculated to be 70 meq/kg of pulp. The kappa number of the treated pulp was 10.6.

According to the invention, a considerable amount of hexenuronic acid groups can be removed from sulphate pulp, with resulting significant drop in kappa number (used for representing the delignification grade). A similar reduction can be expected to occur in the consumption of electrophilic bleaching chemicals reacting with hexenuronic acid.

EXAMPLE 6

Pine sulphate pulp bleached with oxygen and peroxide (9 g, kappa number 5.3) was treated in 0.06 M formiate buffer (pH 3.2, 600 ml) at a temperature of 100° C. for 2.5 hours. Degradation of hexenuronic acid groups was followed by means of absorption of light (250 nm, ϵ=8,700) caused by 2-furan-carboxylic acid.

The total amount of hexenuronic acid groups was calculated to be 48 meq/kg of pulp. All hexenuronic acid groups were removed from the pulp in the reaction time of about 30 minutes. The treated pulp was filtered in a Bichner funnel, and washed with water. Compared with the original pulp, the treated pulp was infiltrated very easily. The kappa number of the treated pulp was 2.3.

The kappa number of sulphate pulp bleached with oxygen and peroxide according to the invention is very low after treatment removing hexenuronic acid groups. The treatment according to the invention significantly improves possibilities to produce full-bleached TCF pulps without ozone bleaching.

EXAMPLE 7

Birch sulphate pulp (100 g, kappa nurabar 11.6) bleached with oxygen was mixed in water (3 1). The pH of the suspension was adjusted to the value 3,4 by adding 2 ml strong formic acid. The suspension produced in this way was incubated at a temperature, of 100° C. for 4 hours. Degradation of hexenuronic acid groups was followed by means of UW absorption (250 nm, ϵ=8,700) caused by 2-furan carboxylic acid. The amount of the removed hexenuronic acid was calculated to be 54 meq/kg of pulp, which is approximately 98% of the total amount of hexenuronic acid groups of the pulp. The kappa number of the treated pulp was 6.2.

Chelating With EDTA (0.2% of the pulp) was carried out to both treated and non-treated pulp at a concentration of 3.5%. The treatment was practiced at a temperature of 60° C., the duration thereof being 45 minutes.

After washing, peroxide bleaching (3% of the pulp being hydrogen peroxide) was effected to the pulps at a concentration of 10%. Magnesium sulphate (0.5% of the pulp) was used as stabilizer, and sodium hydroxide (1.8% of the pulp) as alkali, the temperature being 90° C. and the bleaching time 180 minutes. The kappa number, viscosity, brightness and brightness reversion tendency (pc number) were defined of the washed pulps. The characteristics of the pulps are shown in Table 1.

Table 1. The effect of the pre-treatment (A) on bleachability with peroxide (P) of birch sulphate pulp bleached with oxygen (0).

TABLE 1

The effect of the pre-treatment (A) on bleachability with peroxide (P) of birch sulphate pulp bleached with oxygen (O).

| Stage | Residue $H_2O_2$ (% of pulp) | Kappa no. | Viscosity (ml/g) | Brightness (% ISO) | pc no. |
|---|---|---|---|---|---|
| O | | 11.5 | 1165 | 49.7 | |
| OP | 0 | 9.3 | 1125 | 61.0 | 2.5 |
| OA | | 6.2 | 1065 | 49.9 | |
| OAP | 2.1 | 3.2 | 980 | 76.1 | 1.1 |

The results show that the pre-treatment strongly affected the action of the pulp in the peroxide stage. The consumption of peroxide was crucially reduced, but in spite of that, the rise in brightness was more than twice as great compared to the non-treated pulp. The brightness reversion tendency of the pre-treated pulp was, expressed as a pc number, over 50% lower than the brightness reversion tendency of the non-treated pulp.

EXAMPLE 8

Unbleached birch sulphate pulp (kappa number 15.4) was treated with formic acid at a concentration of 5% so that the pH of the slush was 3.0, 3.5 or 4.0. The pulps treated in this way were incubated in 150 ml-pressure vessels at temperatures of 85, 95, 105 and 115° C. for 0.2–24 hours. Disengagement of hexenuronic acid groups was followed by defining the concentrations of furan derivatives having formed out of hexenuronic acid groups in the filtrate. The kappa number and viscosity were defined of the incubated pulps.

The decrease in the kappa number was in a linear way dependent on the decrease in the hexenuronic acid concentration. The maximal reduction of hexenuronic acid concentration was 50 meq/kg, corresponding to a 6.3-unit reduction of the kappa number. 90% of the hexenuronic acid being removed, the yield of the treatment was 98% calculated on the basis of TOC. The degradation of hexenuronic acid groups was in accordance with the first-order reaction kinetics. The minimum retention time (reduction of 60% in the hexenuronic acid concentration) required by the treatment, and the optimal retention time (reduction of 80–95% in the hexenuronic acid concentration) are illustrated by means of curves fitted to experimental points (FIG. 2). At pH 3.0–3.6 the degradation velocity of hexenuronic acid was very close to its maximum value. At higher pH values the retention times required are longer due to a slower reaction velocity.

EXAMPLE 9

Birch sulphate pulp kappa number 10.3) bleached with oxygen was treated under conditions according to Example 8 to remove hexenuronic acid groups. The kappa number after the treatment was 5.4. Both acid-treated and non-treated pulp was bleached with DED sequence using several doses of chlorine dioxide and alkali. Being bleached to the brightness level 88.0% ISO, the acid-treated pulp consumed 2.6% chlorine dioxide calculated as active chlorine, and 1.4 % sodium hydroxide. The corresponding consumption percentages chlorine dioxide and sodium hydroxide by the non-treated pulp were 4.3 and 0.8, respectively. The yield of the DED sequence was 97.1% for the acid-treated pulp and 95.5% for the non-treated pulp. Thus, removal of hexenuronic acid caused the consumption of chemicals of the ECF bleaching to decrease by 42–43% without lowering the yield of the bleaching. The tensile index and tear index of the sheets made of the pulps were identical at the same density of the sheet.

EXAMPLE 10

Pine sulphate pulp (100 g, kappa number 25.9) was mixed in water (31). The pH of the suspension was adjusted to the value 3.5 by adding 1.6 ml strong formic acid. The suspension produced in this way was incubated at a temperature of 100° C. for 2.5 hours. Degradation of hexenuronic acid groups was followed by means of UV absorption (250 nm, $\epsilon$–8,700) caused by 2-furan-carboxyl acid. The total amount of the removed hexenuronic acid was calculated to be 32 meq/kg of pulp, which corresponds to about 95% of all hexenuronic acid of the pulp. Chelating with EDTA (0.2% of the pulp) was carried out to both non-treated and treated pulp at a concentration of 3%. The treatment was effected at a temperature of 50° C., the duration thereof being 45 minutes, The metal concentrations of the pulps were defined with an atomic absorption spectrophotometer.

The treatment removing hexenuronic add especially decreased the iron and manganese concentrations of the pulp (Table 2). The decrease in iron in this case significantly greater than when using chelate treatment, and even the decrease in manganese was as great as when using chelate treatment.

Table 2. The effect of the pre-treatment (A) and chelating (0) on metal concentrations of pine sulphate pulp (mg/kg)

TABLE 2

The effect of the pre-treatment (A) and chelating (O) on metal concentrations of pine sulphate pulp (mg/kg)

| Treatment | Iron | Copper | Manganese |
|---|---|---|---|
| — | 22.0 | 6.5 | 36.8 |
| A | 10-7 | 5.7 | 2.4 |
| Q | 20.9 | 0.9 | 1.8 |
| AQ | 10.4 | 1.3 | 0.2 |

Since iron and manganese are the most detrimental metals as—regards to TCF bleaching, the use of chelating agents may be replaced either partly or totally with treatment removing hexenuronic acid. If chelating agents are used, it is preferable to add them in connection with the treatment removing hexenuronic acid.

While the invention has been described in connection with what is presently considered to be the most practical and preferred embodiment, it is to be understood that the invention is not to be limited to the disclosed embodiment, but on the contrary, is intended modifications and equivalent arrangements included within the spirit and scope of the appended claims.

What is claimed is:

1. A method of treating chemical cellulose pulp produced by alkaline delignification and having a kappa number of under 24, having hexenuronic acid therein, comprising the steps of:

(a) treating chemical cellulose pulp produced by alkaline delignification having a kappa number under 24 and at a solids consistency of between 0.1–50% by treating the pulp at a temperature over 85° C. and at a pH between about 2–5 for sufficient time to remove at least 50% of the hexenuronic acid and to reduce the kappa number by at least 2 units; and (b) bleaching the chemical cellulose pulp produced by alkaline delignification having a kappa number under 24 in at least one bleaching stage.

2. A method as recited in claim 1 wherein step (a) is practiced for at least a time t, where $t=0.5\exp(10517/(T+273)-24)$, in minutes, and where T is the treatment temperature in degrees C.

3. A method as recited in claim 2 wherein step (a) is practiced at a pH between about 3–4.

4. A method as recited in claim 3 wherein step (a) is practiced at a temperature at or above approximately 90° C.

5. A method as recited in claim 1 wherein step (b) is practiced by bleaching the pulp with chemicals reacting electrophilically in at least one stage, and wherein step (a) is practiced before step (b).

6. A method as recited in claim 5 wherein step (b) is practiced by chlorine, chlorine dioxide, ozone, or peracid bleaching.

7. A method as recited in claim 1 wherein step (a) is practiced with the pulp at a consistency of between 1–20%.

8. A method as recited in claim 1 wherein step (a) is practiced at a temperature of between about 90–110° C., and a pH of between about 2.5–4.

9. A method as recited in claim 1 wherein step (a) is practiced by controlling the pH by the addition of an inorganic or organic acid, and at a temperature over 100° C.

10. A method as recited in claim 1 wherein step (a) is practiced for sufficient time to remove at least 80% of the hexenuronic acid.

11. A method as recited in claim 10 wherein step (a) is practiced at a temperature of between about 90–110° C. and a pH of between about 3–4 for between 10–240 minutes.

12. A method as recited in claim 1 wherein the pulp treated in step (a) is hardwood pulp having a kappa number of about 14 or less.

13. A method as recited in claim 1 wherein step (b) is practiced by bleaching the pulp in an ozone stage, followed by at least one additional bleaching stage.

14. A method as recited in claim 1 wherein step (b) is practiced by bleaching the pulp with a single hydrogen peroxide stage, and no other bleaching stages, to produce pulp having a post color number of less than 2.

15. A method as recited in claim 1 wherein step (b) is practiced by bleaching the pulp in an oxygen stage, followed by at least one additional bleaching stage.

16. A method as recited in claim 1 wherein step (a) is practiced to reduce the kappa number about 3–6 unit, and to remove at least 80% of the hexenuronic acid, and so that the pulp produced has post color number less than 2.

17. A method as recited in claim 2 comprising the further step of dignifying the pulp with oxygen prior to step (a) so that it has a kappa number of about 14 or less; and wherein step (b) is practiced after step (a).

18. A method as recited in claim 1 wherein step (a) is practiced at a pH between about 3–4.

19. A method of producing chemical cellulose pulp, comprising the steps of:

(a) effecting alkaline delignification of comminuted cellulosic fibrous material to produce chemical cellulose pulp having a kappa number of under 24, and having hexenuronic acid therein;

(b) treating the chemical cellulose pulp from step (a) at a temperature of between about 90–180° C. and at a pH between about 2–5 for at least a time t, where t=0.5 exp(10517/(T+273)−24), in minutes, and where T is the treatment temperature in degrees C., to remove at least 50% of the hexenuronic acid from the pulp; and (c) bleaching the chemical cellulose pulp from step (a) in at least one bleaching stage prior to, simultaneously with, or after step (b).

20. A method as recited in claim 19 wherein step (b) is practiced at atmospheric pressure for a time between 10–360 minutes, or at super atmospheric pressure and a temperature of over 100° C. for a time between 5–100 minutes, and to remove about 80–97% of the hexenuronic acid.

21. A method as recited in claim 19 wherein step (b) is practiced at a pH between about 3–4.

22. A cellulose chemical pulp produced by the steps of:

(a) effecting alkaline delignification of comminuted cellulosic fibrous material to produce chemical cellulose pulp having a kappa number of under 24, and having hexenuronic acid therein;

(b) treating the chemical cellulose pulp from step (a) at a solids consistency between 0.1–60% at a temperature of between about 90–180° C. and at a pH between 2.0–5.0 for at least a time t, where t=0.5 exp(10517/(T+273)−24), in minutes, and where T is the treatment temperature in degrees C., to remove at least 50% of the hexenuronic acid from the pulp; and (c) bleaching the chemical cellulose pulp from step (a) in at least one bleaching stage prior to, or after, step (b), so that the pulp has a brightness of at least about 80 ISO.

23. A cellulose chemical pulp as recited in claim 22 wherein step (c) is practiced using hydrogen peroxide, and wherein post color number of the pulp is less than two.

24. A cellulose chemical pulp as recited in claim 22 wherein step (b) is practiced at a pH between about 3–4.

25. A method of treating and bleaching chemical cellulose pulp produced by alkaline delignification and having a kappa number under 24, having hexenuronic acid therein, comprising the steps of:

(a) treating chemical cellulose pulp produced by alkaline delignification having a kappa number under 24 and at a solids consistency between 0.1–50% by treating the pulp at a temperature over 85° C. and at a pH between about 2–5 for sufficient time to remove at least about 50% of the hexenuronic acid and to decrease the kappa number of the pulp by at least 2 units; and (b) bleaching the chemical cellulose pulp from step (a) in at least one bleaching stage with chlorine, chloride dioxide, ozone, or peracid.

26. A method of treating and bleaching chemical cellulose pulp produced by alkaline delignification and having a kappa number under 24, having hexenuronic acid therein, comprising the steps of:

(a) treating chemical cellulose pulp produced by alkaline delignification having a kappa number under 24 and at a solids consistency between 0.1–50% by treating the pulp at a temperature over 85° C. and at a pH between about 2–5 for sufficient time to remove at least about 50% of the hexenuronic acid and to decrease the kappa number of the pulp by at least 2 units;

(b) treating the pulp with a chelating agent; and (c) bleaching the pulp in at least one bleaching stage with peroxide.

27. A method of treating and bleaching chemical cellulose pulp produced by alkaline delignification and having a kappa number under 24, having hexenuronic acid therein, comprising the steps of:

(a) treating chemical cellulose pulp produced by alkaline delignification having a kappa number under 24 and at a solids consistency between 0.1–50% by treating the pulp at a temperature over 85° C. and at a pH between about 2–5 for at least a time t, where t=0.5 exp (10517/(T+273)−24) to remove at least bout 50% of the hexenuronic acid and to decrease the kappa number of the pulp by at least 2 units; and (b) bleaching the chemical cellulose pulp from step (a) having the reduced kapps number and the reduced hexenuronic acid content in at least one bleaching stage with peroxide.

* * * * *